US010731467B2

(12) United States Patent
Yoshida et al.

(10) Patent No.: US 10,731,467 B2
(45) Date of Patent: Aug. 4, 2020

(54) TURBINE

(71) Applicant: MITSUBISHI HEAVY INDUSTRIES ENGINE & TURBOCHARGER, LTD., Sagamihara-shi, Kanagawa (JP)

(72) Inventors: Toyotaka Yoshida, Tokyo (JP); Takao Yokoyama, Tokyo (JP)

(73) Assignee: MITSUBISHI HEAVY INDUSTRIES ENGINE & TURBOCHARGER, LTD., Kanagawa (JP)

( * ) Notice: Subject to any disclaimer, the term of this patent is extended or adjusted under 35 U.S.C. 154(b) by 414 days.

(21) Appl. No.: 15/329,959

(22) PCT Filed: Sep. 30, 2014

(86) PCT No.: PCT/JP2014/076167
§ 371 (c)(1),
(2) Date: Jan. 27, 2017

(87) PCT Pub. No.: WO2016/051531
PCT Pub. Date: Apr. 7, 2016

(65) Prior Publication Data

US 2017/0260861 A1 Sep. 14, 2017

(51) Int. Cl.
*F01D 5/04* (2006.01)
*F01D 5/14* (2006.01)
(Continued)

(52) U.S. Cl.
CPC ..... *F01D 5/04* (2013.01); *F01D 5/14* (2013.01); *F01D 5/143* (2013.01); *F01D 11/08* (2013.01);
(Continued)

(58) Field of Classification Search
CPC ... F01D 5/04; F01D 5/14; F01D 5/143; F01D 9/026; F01D 11/08; F01D 9/02;
(Continued)

(56) References Cited

U.S. PATENT DOCUMENTS 6,877,955 B2 4/2005 Higashimori et al.
7,481,625 B2 1/2009 Kim
(Continued)

FOREIGN PATENT DOCUMENTS

CN 100482949 C 4/2009
CN 100504035 C 6/2009
(Continued)

OTHER PUBLICATIONS

International Search Report for PCT/JP2014/076167 dated Dec. 22, 2014.
(Continued)

*Primary Examiner* — Philip E Stimpert
(74) *Attorney, Agent, or Firm* — Birch, Stewart, Kolasch & Birch, LLP

(57) ABSTRACT

A turbine includes a housing including an inlet, an outlet, and a shroud section having a shroud surface extending between the inlet and the outlet; and a turbine impeller housed in the housing and including a hub and a plurality of blades disposed on an outer peripheral surface of the hub, each of the blades having a side edge extending along the shroud surface. The side edge of each of the blades has a side-edge upstream portion disposed on a side of the inlet, and a side-edge downstream portion disposed on a side of the outlet. The shroud surface has a shroud upstream portion disposed on the side of the inlet and extending along the side-edge upstream portion, and a shroud downstream portion disposed on the side of the outlet and extending along the side-edge downstream portion. The shroud upstream portion has a meridional cross-sectional shape whose inclination angle ($\theta_1$) with respect to an axis (L) of the hub at the side of the inlet is smaller than in a case where the shroud upstream portion has a meridional cross-sectional shape of an arc shape and the shroud downstream portion has a
(Continued)

meridional cross-sectional shape of a linear shape along a direction of the axis of the hub.

3 Claims, 13 Drawing Sheets

(51) Int. Cl.
*F01D 11/08* (2006.01)
*F04D 29/52* (2006.01)

(52) U.S. Cl.
CPC ..... *F04D 29/526* (2013.01); *F05D 2220/40* (2013.01)

(58) Field of Classification Search
CPC .... F01D 11/14; F04D 29/526; F04D 2220/40; F05D 2220/40
See application file for complete search history.

(56) References Cited

U.S. PATENT DOCUMENTS

| | | | | |
|---|---|---|---|---|
| 2004/0105756 | A1 | 6/2004 | Higashimori et al. | |
| 2006/0039791 | A1* | 2/2006 | Kim | F01D 5/048 416/228 |
| 2014/0154069 | A1* | 6/2014 | Martinez-Botas Mateo | F01D 5/141 415/208.1 |

FOREIGN PATENT DOCUMENTS

| | | | |
|---|---|---|---|
| CN | 102011614 | A | 4/2011 |
| EP | 1 394 359 | A2 | 3/2004 |
| JP | 5-340265 | A | 12/1993 |
| JP | 8-109801 | A | 4/1996 |
| JP | 9-144550 | A | 6/1997 |
| JP | 9-310601 | A | 12/1997 |
| JP | 2002-349202 | A | 12/2002 |
| JP | 2004-92498 | A | 3/2004 |
| JP | 2013-204422 | A | 10/2013 |

OTHER PUBLICATIONS

International Preliminary Report on Patentability received Apr. 13, 2017, issued to International Application No. PCT/JP2014/076167.
Office Action effective Jul. 12, 2017 issued to the corresponding Chinese Application No. 201480080395.9 with a Machine English Translation.
Extended European Search Report effective Jun. 8, 2017 issued to the corresponding European Application No. 14903348.2.
Office Action effective Jul. 30, 2018 issued to the corresponding EP Application No. 14903348.2 with a Machine Translation.
Office Action received Aug. 4, 2017 issued in the corresponding JP Application No. 2016-551404 with an English Translation.
Office Action effective Mar. 14, 2019 issued in the corresponding European Patent Application No. 14903348.2.

* cited by examiner

TURBINE

TECHNICAL FIELD

The present disclosure relates to a turbine.

BACKGROUND ART

Patent Document 1 discloses a turbine including a housing and a turbine impeller housed in the housing. The housing has an inlet, an outlet, and a shroud surface extending between the inlet and the outlet. The turbine impeller includes a hub and a plurality of blades disposed on the outer peripheral surface of the hub. Each of the blades has a side edge extending along the shroud surface. In such a turbine, the side edge of each blade has a side-edge upstream portion disposed on the inlet side and a side-edge downstream portion disposed on the outlet side, while the shroud surface has a shroud upstream portion disposed on the inlet side and extending along the side-edge upstream portion and a shroud downstream portion disposed on the outlet side and extending along the side-edge downstream portion. Furthermore, the shroud upstream portion has an arc-shaped meridional cross-sectional shape, and the shroud downstream portion has a linear meridional cross-sectional shape along the axial direction of the hub.

CITATION LIST

Patent Literature

Patent Document 1: JP2013-204422A

SUMMARY

Problems to be Solved

Generally, in a turbine, a minute gap exists between the side edge of each blade and the shroud surface. Thus, a clearance flow is generated, which is a part of a fluid entering through the inlet of the housing and leaking in the circumferential direction through the gap (clearance).

The clearance flow makes up a great percentage of loss that occurs in a turbine. While one may consider narrowing the clearance between the blade side edges and the shroud surface to reduce the clearance flow, the clearance cannot be eliminated due to a risk of contact between the blade side edges and the shroud surface caused by shaft vibration or thermal extension of the turbine impeller.

Furthermore, while one may consider covering the turbine impeller with a shroud ring like an axial-flow turbine, providing a shroud ring may increase the weight and raise a problem of centrifugal stress if the turbine is operated also in a high-speed range.

In view of the above issues, an object of at least one embodiment of the present invention is to provide a turbine with a reduced clearance flow of a fluid flowing through clearance between blade side edges and a shroud surface.

Solution to the Problems

To achieve the above object, the present inventors carried out extensive researches. As a result, it was found that a flow of a fluid closer to blades in the circumferential direction at an inlet (hereinafter, also referred to as "vicinity flow") passes through a more upstream region of clearance, while a flow of the fluid farther from the blades (hereinafter, also referred to as "intermediate flow") passes through a more downstream region of the clearance. Furthermore, it was found that it is possible to narrow the region in which the intermediate flow passes through the clearance by expanding the region in which the vicinity flow passes through the clearance toward the downstream side, thereby suppressing passage of the intermediate flow through the clearance. On the basis of these findings, the present inventors arrived at the present invention described below.

(1) A turbine according to at least one embodiment of the present invention comprises: a housing including an inlet, an outlet, and a shroud section having a shroud surface extending between the inlet and the outlet; and a turbine impeller housed in the housing and including a hub and a plurality of blades disposed on an outer peripheral surface of the hub, each of the blades having a side edge extending along the shroud surface. The side edge of each of the blades has a side-edge upstream portion disposed on a side of the inlet, and a side-edge downstream portion disposed on a side of the outlet. The shroud surface has a shroud upstream portion disposed on the side of the inlet and extending along the side-edge upstream portion, and a shroud downstream portion disposed on the side of the outlet and extending along the side-edge downstream portion. The shroud upstream portion has a meridional cross-sectional shape whose inclination angle with respect to an axis of the hub at the side of the inlet is smaller than in a case where the shroud upstream portion has a meridional cross-sectional shape of an arc shape and the shroud downstream portion has a meridional cross-sectional shape of a linear shape along a direction of the axis of the hub.

With the above configuration (1), it is possible to narrow the region in which the intermediate flow passes through the clearance by expanding the region in which the vicinity flow passes through the clearance toward the downstream side, thereby suppressing passage of the intermediate flow through the clearance. Accordingly, the clearance flow of a fluid flowing through the gap between the side edges of the blades and the shroud surface is reduced.

(2) In some embodiments, in the above configuration (1), the shroud upstream portion has a meridional cross-sectional shape having a curvature radius R defined by the following expression 1:

$$R \geqq \frac{(R1 - R2t)^2 + Ls^2}{2(R1 - R2t)}$$

where R1 is a distance in a radial direction from the axis of the hub to the inlet, R2*t* is a distance in the radial direction from the axis of the hub to the outlet, and Ls is a length of the shroud surface in the direction of the axis of the hub.

With the above configuration (2), the meridional cross-sectional shape of the shroud upstream portion has a curvature radius R defined by the expression 1, and thus it is possible to reduce the inclination angle with respect to the axis of the hub reliably.

(3) In some embodiments, in the above configuration (1) or (2), the shroud downstream portion includes an arc portion having a meridional cross-sectional shape of an arc shape.

With the above configuration (3), since the shroud downstream portion includes the arc portion, it is possible to reduce the inclination angle of the shroud downstream portion with respect to the axis of the hub gradually toward the outlet.

(4) In some embodiments, in the above configuration (3), the arc portion has a meridional cross-sectional shape of a true arc shape.

With the above configuration (4), since the arc portion has a meridional cross-sectional shape of a true arc shape, it is possible to reduce the inclination angle of the shroud downstream portion with respect to the axis of the hub gradually toward the outlet.

(5) In some embodiments, in the above configuration (3), the arc portion has a meridional cross-sectional shape of an oval arc shape.

With the above configuration (5), since the arc portion has a meridional cross-sectional shape of an oval arc shape, it is possible to reduce the inclination angle of the shroud downstream portion with respect to the axis of the hub gradually toward the outlet.

(6) In some embodiments, in any one of the above configurations (3) to (5), the arc portion has a center of curvature which is positioned on a line passing through the outlet and intersecting with the direction of the axis of the hub at right angle, or downstream of the line in the direction of the axis of the hub.

With the above configuration (6), it is possible to set the inclination angle of the shroud surface with respect to the axis of the hub to zero degree or more.

(7) In some embodiments, in any one of the above configurations (1) to (6), the shroud upstream portion includes a linear portion having a meridional cross-sectional shape of a linear shape.

With the above configuration (7), since the shroud upstream portion includes the linear portion, it is possible to make the inclination angle of the shroud upstream portion with respect to the axis of the hub constant.

(8) In some embodiments, in any one of the above configurations (1) to (7), the shroud downstream portion forms an inclination angle of zero degree with the axis of the hub, at the outlet in a meridional cross section.

With the above configuration (8), since the inclination angle of the shroud surface is zero degree at the outlet, it is possible to discharge a fluid smoothly through the outlet.

(9) In some embodiments, in the above configuration (1) or (2), the shroud downstream portion includes a linear portion having a meridional cross-sectional shape of a linear shape inclined from the axis of the hub.

With the above configuration (10), since the shroud downstream portion includes the linear portion, it is possible to make the inclination angle of the shroud downstream portion with respect to the axis of the hub constant.

(10) In some embodiments, in the above configuration (1) or (2), the shroud surface has a meridional cross-sectional shape of a linear shape connecting the inlet and the outlet.

With the above configuration (10), it is possible to make the inclination angle of the shroud surface with respect to the axis of the hub constant.

(11) In some embodiments, in the above configuration (1) or (2), the shroud surface has a meridional cross-sectional shape of an arc shape having a curvature radius R defined by the following expression 2:

$$R = \frac{(R1 - R2t)^2 + Ls^2}{2(R1 - R2t)}$$

where R1 is a distance in a radial direction from the axis of the hub to the inlet, R2*t* is a distance in the radial direction from the axis of the hub to the outlet, and Ls is a length of the shroud surface in the direction of the axis of the hub.

With the above configuration (11), the shroud surface has a meridional cross-sectional shape of an arc shape, and the arc shape has a curvature radius R defined by the expression 2, and thus it is possible to reduce the inclination angle of the shroud surface with respect to the axis of the hub reliably.

(12) In some embodiments, in any one of the above configurations (1) to (11), a ratio Ls/D1 of a length Ls to an inner diameter D1 is greater than 0.16, provided that D1 is an inner diameter of the shroud at the inlet and Ls is a length of the shroud surface in the direction of the axis of the hub.

If the ratio of the length Ls to the inner diameter D1, Ls/D1, is not more than 0.16, the area of the blade that receives a rotational force from the fluid is relatively small, which leads to a decrease in the efficiency of the turbine. On the other hand, if the ratio Ls/D1 is greater than 0.16, the area of the blade is relatively large and the efficiency of the turbine improves, but a region in which the clearance flow occurs is also larger, and loss from the clearance flow increases.

In this regard, with the above configuration (12), the clearance flow is reduced even if the ratio Ls/D1 is greater than 0.16, and thus it is possible to suppress a loss increase while improving the turbine efficiency.

(13) In some embodiments, in any one of the above configurations (1) to (12), a ratio of a distance R2*t* to a distance R1 is not more than 0.95, provided that R1 is a distance in a radial direction from the axis of the hub to the inlet, and R2*t* is a distance in the radial direction from the axis of the hub to the outlet.

With the above configuration (13), reduction of the clearance flow is considerably effective in improving the efficiency of the turbine.

(14) A turbine according to at least one embodiment of the present invention comprises: a housing including an inlet, an outlet, and a shroud section having a shroud surface extending between the inlet and the outlet; and a turbine impeller housed in the housing and including a hub and a plurality of blades disposed on an outer peripheral surface of the hub, each of the blades having a side edge extending along the shroud surface. The side edge of each of the blades has a side-edge upstream portion disposed on a side of the inlet, and a side-edge downstream portion disposed on a side of the outlet. The shroud surface is formed by a single arc portion having a meridional cross-sectional shape of an arc shape. The arc portion has a meridional cross-sectional shape having a curvature radius R defined by the following expression 3:

$$R \geqq \frac{(R1 - R2t)^2 + Ls^2}{2(R1 - R2t)}$$

where R1 is a distance in a radial direction from the axis of the hub to the inlet, R2*t* is a distance in the radial direction from the axis of the hub to the outlet, and Ls is a length of the shroud surface in the direction of the axis of the hub.

With the above configuration (14), it is possible to narrow the region in which the intermediate flow passes through the clearance by expanding the region in which the vicinity flow passes through the clearance toward the downstream side, thereby suppressing passage of the intermediate flow through the clearance. Accordingly, the clearance flow of a fluid flowing through the gap between the side edges of the blades and the shroud surface is reduced.

(15) A turbine according to at least one embodiment of the present invention comprises: a housing including an inlet, an outlet, and a shroud section having a shroud surface extending between the inlet and the outlet; and a turbine impeller housed in the housing and including a hub and a plurality of blades disposed on an outer peripheral surface of the hub, each of the blades having a side edge extending along the shroud surface. The shroud surface is formed by a single linear portion having a meridional cross-sectional shape of a linear shape.

With the above configuration (15), it is possible to narrow the region in which the intermediate flow passes through the clearance by expanding the region in which the vicinity flow passes through the clearance toward the downstream side, thereby suppressing passage of the intermediate flow through the clearance. Accordingly, the clearance flow of a fluid flowing through the gap between the side edges of the blades and the shroud surface is reduced.

Advantageous Effects

According to at least one embodiment of the present invention, it is possible to narrow the region in which the intermediate flow passes through the clearance by expanding the region in which the vicinity flow passes through the clearance toward the downstream side, which makes it possible to suppress passage of the intermediate flow through the clearance. Accordingly, the clearance flow of a fluid flowing through the gap between the side edges of the blades and the shroud surface is reduced.

DETAILED DESCRIPTION

Embodiments of the present invention will now be described in detail with reference to the accompanying drawings. It is intended, however, that unless particularly specified, dimensions, materials, shapes, relative positions and the like of components described in the embodiments shall be interpreted as illustrative only and not intended to limit the scope of the present invention.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

Figure 1:
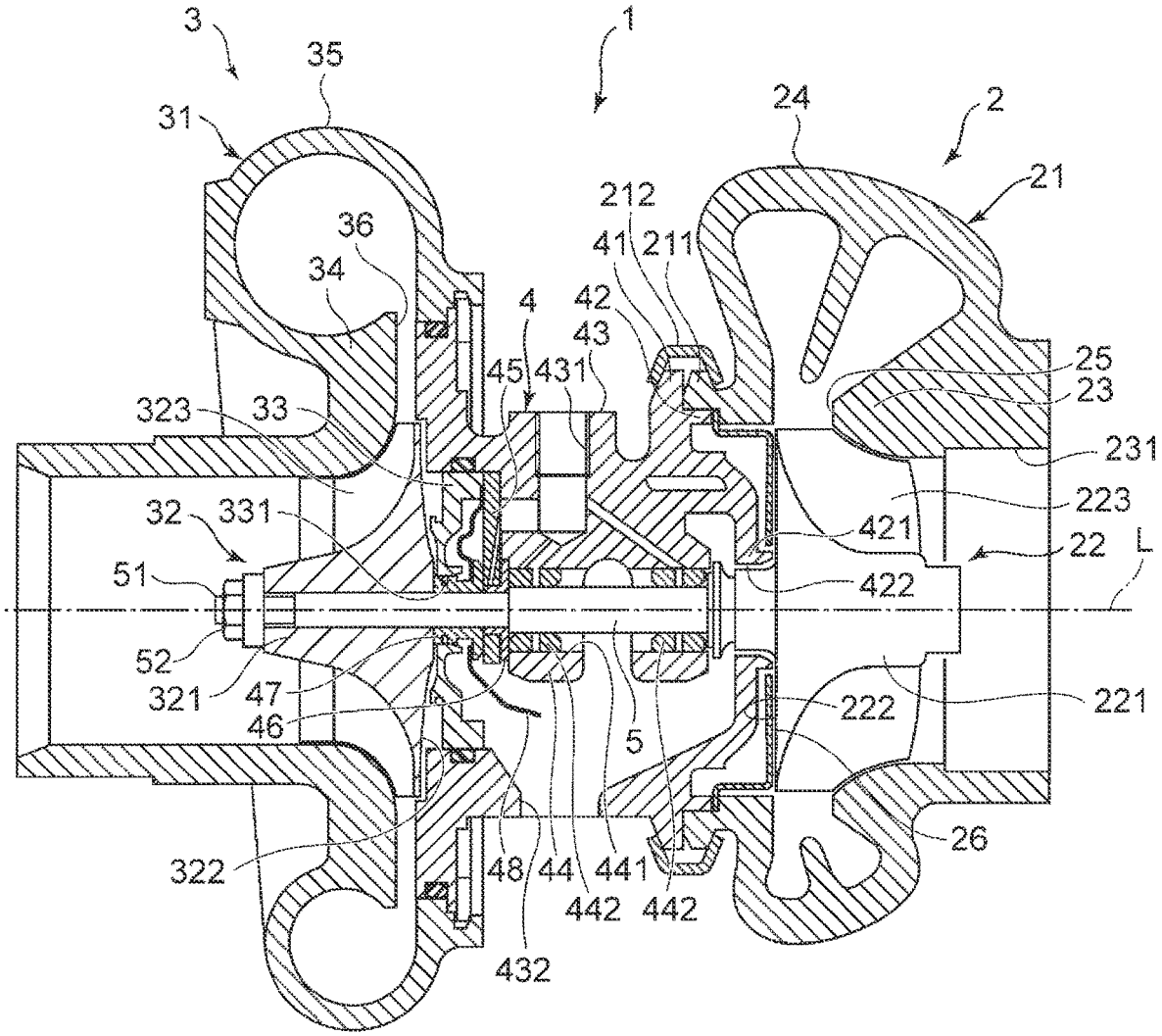
FIG. 1 is a vertical cross-sectional view schematically showing a configuration of a turbocharger according to an embodiment of the present invention.

FIG. 1 is a vertical cross-sectional view schematically showing a configuration of a turbocharger according to an embodiment of the present invention.

As depicted in FIG. 1, a turbocharger 1 includes a turbine 2 and a compressor 3 of centrifugal type.

The turbine 2 includes a housing (turbine housing) 21, a turbine impeller 22 accommodated rotatably inside the turbine housing 21, while the compressor 3 includes a housing (compressor housing) 31 and an impeller (compressor impeller) 32 accommodated rotatably in the compressor housing 31.

The turbine housing 21 and the compressor housing 31 are disposed on either side of the bearing housing 4 across the bearing housing 4, and are coupled to the bearing housing 4. The bearing housing 4 and the turbine housing 21 are fixed by fastening via respective connection flanges 41 and 211 with a ring-shaped coupling 212, at the end portions of the bearing housing 4 and the turbine housing 21. The turbine impeller 22 of the turbine 2 and the impeller 32 of the compressor 3 are coupled to each other by a drive shaft (turbine rotor) 5 which is integrated with the turbine impeller 22 and which extends inside the bearing housing 4. Thus, the turbine impeller 22, the impeller 32, and the drive shaft 5 are disposed on the same axis. The turbine impeller 22 of the turbine 2 is rotated by exhaust gas discharged from an internal combustion engine, for instance, whereby the impeller 32 of the compressor 3 is rotated via the drive shaft 5. Rotation of the impeller 32 of the compressor 3 compresses air (intake air) to be supplied to the internal combustion engine.

For instance, the turbine housing 21 includes a cylindrical (shroud) section 23 which accommodates the turbine impeller 22, and a scroll section 24 surrounding the cylindrical section 23 at a part on the side of the bearing housing 4. The scroll section 24 has a non-depicted inlet of exhaust gas, and is in communication with the cylindrical section 23 via a throat portion 25. An opening 231 of the cylindrical section 23 on the opposite side from the bearing housing 4 forms an outlet of exhaust gas.

The turbine impeller 22 includes a hub 221 and a plurality of blades 223, which are formed integrally. The hub 221 has a shape rotationally symmetric about an axis L, while the blades 223 are formed radially. An end side of the hub 221 is disposed on the side of the outlet of exhaust gas, and the opposite end side of the hub 221 is disposed on the side of the bearing housing 4, in a direction along the axis L. An outer peripheral surface of the hub 221 has a trumpet shape that widens toward the opposite end side, and the hub 221 has a back surface 222 that faces the bearing housing 4 on the opposite end side. The plurality of blades 223 are disposed at intervals in the circumferential direction on the outer peripheral surface of the hub 221.

To an opening of the turbine housing 21 on the side of the bearing housing 4, an end wall 42 of the bearing housing 4 is fitted and engaged. A seal portion 421 of a cylindrical shape is integrally and co-axially disposed on the end wall 42, and the seal portion 421 forms a seal hole 422 penetrating through the center of the end wall 42. An end portion of the drive shaft 5 on the side of the turbine impeller 22 is disposed inside the seal portion 421, and a seal ring (not depicted) is disposed in a gap between the drive shaft 5 and the seal portion 421.

A back plate 26 of an annular shape is disposed in an annular recess between the end wall 42 and a back surface of the turbine impeller 22. An outer peripheral portion of the back plate 26 is sandwiched by the turbine housing 21 and the bearing housing 4, and an inner peripheral portion of the back plate 26 surrounds the seal portion 421.

A bearing section 44 is disposed integrally with a peripheral wall 43 inside the bearing housing 4, and a bearing hole 441 is formed in the bearing section 44. Two floating bushes 442, for instance, are disposed inside the bearing hole 441 to function as a radial bearing, and the center part of the drive shaft 5 is disposed inside the bearing hole 441 of the bearing section 44 while being inserted through the floating bushes 442.

A thrust member 45 of a plate shape orthogonal to the axis L is fixed to an end surface of the bearing section 44 on the side of the compressor 3, and the drive shaft 5 is inserted through a through hole of the thrust member 45. A thrust collar 46 and a thrust sleeve 47 are fitted onto the drive shaft 5, and the thrust member 45, the thrust collar 46, and the thrust sleeve 47 form a thrust bearing device.

An oil feed port 431 and an oil drain port 432 are disposed on the peripheral wall 43 of the bearing housing 4, and an oil feed passage for feeding lubricant oil to bearing gaps of a radial bearing device and a thrust bearing device is formed through the bearing section 44 and the thrust member 45. Further, an oil deflector 48 is disposed so as to cover a face of the thrust member 45 on the side of the compressor 3 to prevent lubricant oil from scattering toward the compressor 3.

A lid member 33 with a seal hole 331 in the center is fitted onto an opening of the bearing housing 4 on the side of the compressor 3, and the lid member 33 is fixed to the bearing housing 4. The thrust sleeve 47 is inserted through the seal hole 331 of the lid member 33, and a seal ring (not depicted) is disposed in a gap between the thrust sleeve 47 and the seal hole 331.

For instance, the compressor housing 31 includes a cylindrical (shroud) section 34 accommodating the impeller 32, and a scroll section 35 surrounding the cylindrical section 34 at a part on the side of the bearing housing 4. The scroll section 35 has a non-depicted outlet of air supply, and is in communication with the cylindrical section 34 via a diffuser section 36. An opening of the cylindrical section 34 on the opposite side from the bearing housing 4 forms an inlet of intake air.

The impeller 32 includes a hub 321 and a plurality of blades 323. The hub 321 has a shape which is rotationally symmetric with respect to the axis L. An end side of the hub 321 is disposed on the inlet side of intake air, and the other end side of the hub 321 is disposed on the side of the diffuser section 36, in a direction along the axis L. An outer peripheral surface of the hub 321 has a trumpet shape that widens toward the opposite end side, and the hub 321 has a back surface 322 that faces the lid member 33 on the opposite end side. The plurality of blades 323 are disposed at intervals in the circumferential direction on the outer peripheral surface of the hub 321.

The drive shaft 5 is inserted through the hub 321, and a male screw 51 is formed on a tip end side of the drive shaft 5, the tip end side being positioned on one end side of the hub 321, and a nut 52 as a fastening member screwed onto the male screw 51. The nut 52 is in contact with the one end side of the hub 321, and applies an axial force to the impeller 32 toward the side of the turbine 2 in a direction along the axis L.

In the above described turbocharger 1, a thrust load, which is a difference between a thrust force in the direction of the axis L applied to the turbine impeller 22 and a thrust force applied to the impeller 32, is applied to the drive shaft 5 toward the right side in the drawing (the side of the turbine impeller 22). The thrust member 45 is held between the thrust collar 46 and the thrust sleeve 47 fixed to the drive shaft 5 via the inner periphery. Accordingly, the thrust member 45 slidably contacts the bearing housing 4 to support the thrust load, while rotating with the drive shaft 5.

Figure 2:
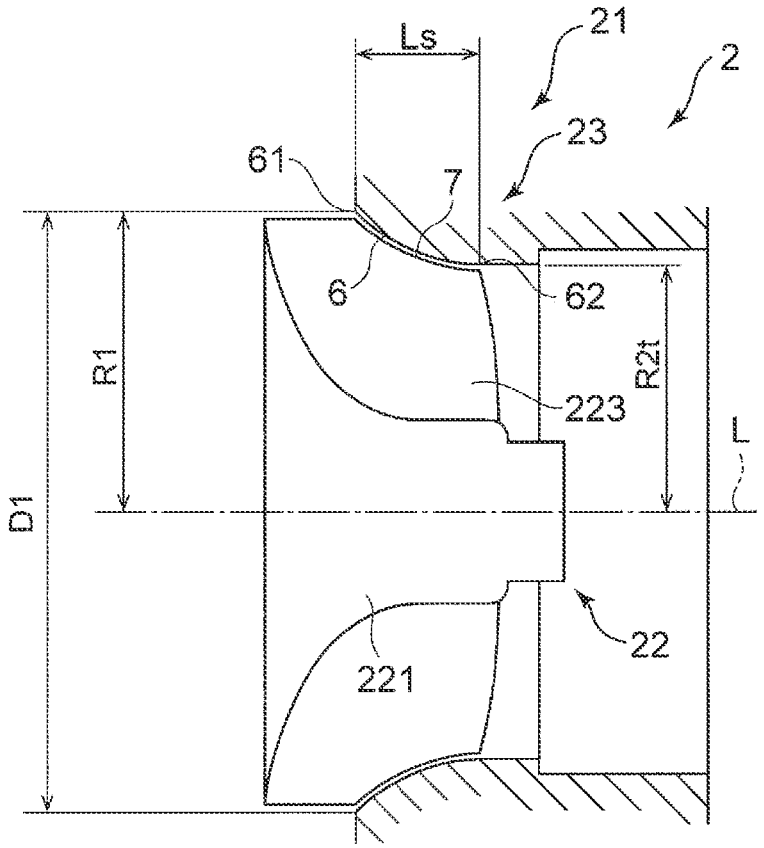
FIG. 2 is a meridional cross-sectional view schematically showing a cylindrical section of a turbine housing and a turbine impeller depicted in FIG. 1.

FIG. 2 is a meridional cross-sectional view schematically showing the cylindrical (shroud) section 23 of the turbine housing 21 and the turbine impeller 22 depicted in FIG. 1.

As depicted in FIG. 2, the cylindrical section 23 of the turbine housing 21 has an inlet 61, an outlet 62, and a shroud surface 6 extending between the inlet 61 and the outlet 62. The turbine impeller 22 includes a hub 221 and a plurality of blades 223 disposed on the outer peripheral surface of the hub 221, each blade 223 including a side edge 7 extending along the shroud surface 6.

Furthermore, as depicted in FIG. 2, distance R1 is greater than distance R2*t* (R1>R2*t*) in the turbine 2 according to some embodiments, provided that R1 is the distance in the radial direction from the axis L of the hub 221 to the inlet 61, and R2*t* is the distance in the radial direction from the axis L of the hub 221 to the outlet 62. More specifically, the ratio of the distance R2*t* to the distance R1, R2*t*/R1, is not more than 0.95. The turbine 2 with the ratio of the distance R2*t* to the distance R1, R2*t*/R1, being not more than 0.95, is a radial turbine and is used at a high pressure ratio, that is, at a high head. The higher the head is, the more leakage flow (clearance flow) is likely to occur, and thus reduction of the clearance flow is considerably effective in improving the efficiency of the turbine 2.

Furthermore, as depicted in FIG. 2, the ratio of the length Ls to the inner diameter D1, Ls/D1, is greater than 0.16 (Ls/D1>0.16) in the turbine 2 according to some embodiments, provided that D1 is the inner diameter at the inlet 61, and Ls is the length of the shroud surface 6 in the direction of the axis L of the hub 221.

If the ratio of the length Ls to the inner diameter D1, Ls/D1, is not more than 0.16, the area of the blade 223 that receives a rotational force from a fluid is relatively small, which leads to a decrease in the efficiency of the turbine 2. On the other hand, if the ratio Ls/D1 is greater than 0.16, the area of the blade 223 is relatively large and the efficiency of the turbine improves, but a region in which the clearance flow occurs is also larger and loss from the clearance flow increases. In this regard, in this embodiment, the clearance flow is reduced even if the ratio Ls/D1 is greater than 0.16, and thus it is possible to suppress a loss increase while improving the turbine efficiency.

Figure 3:
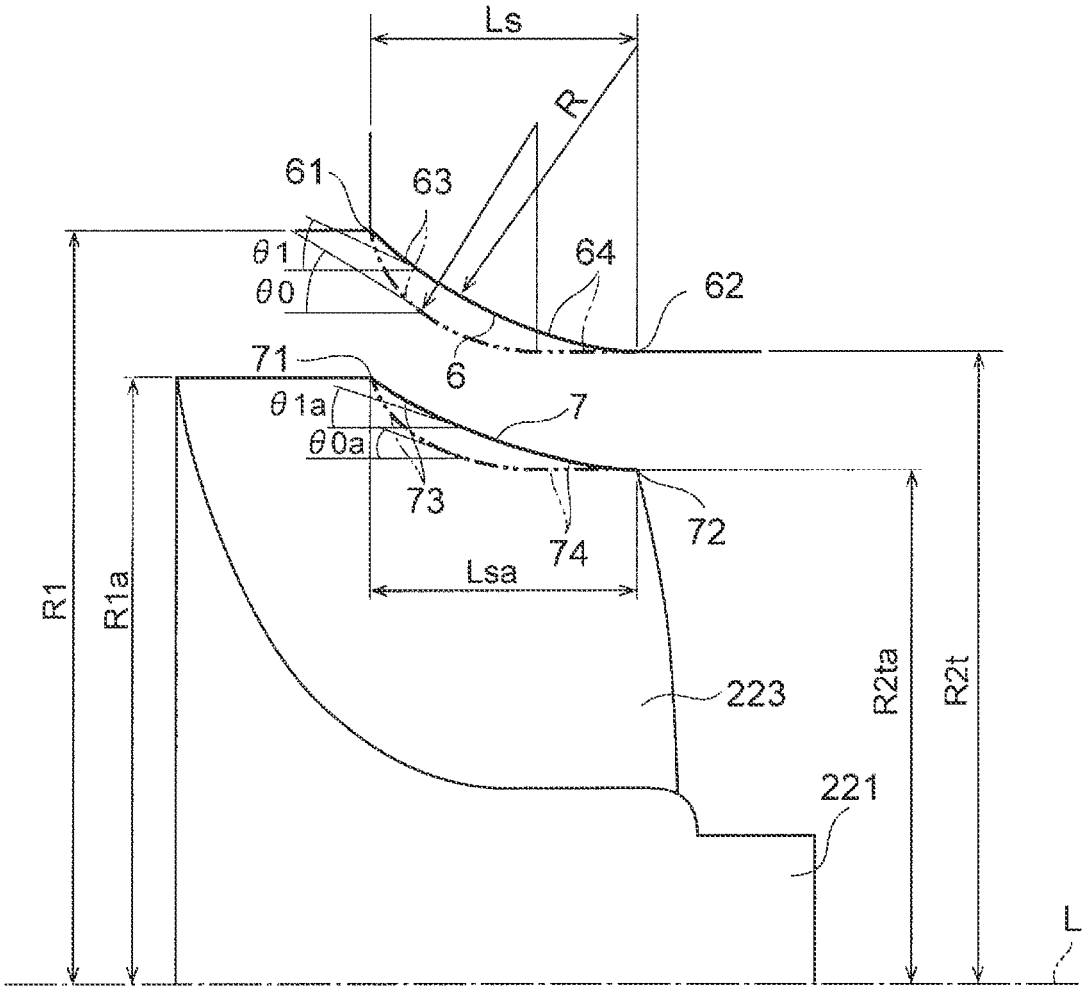
FIG. 3 is a meridional cross-sectional view schematically showing a shroud surface and a side edge of a blade depicted in FIG. 2.
Figure 4B:
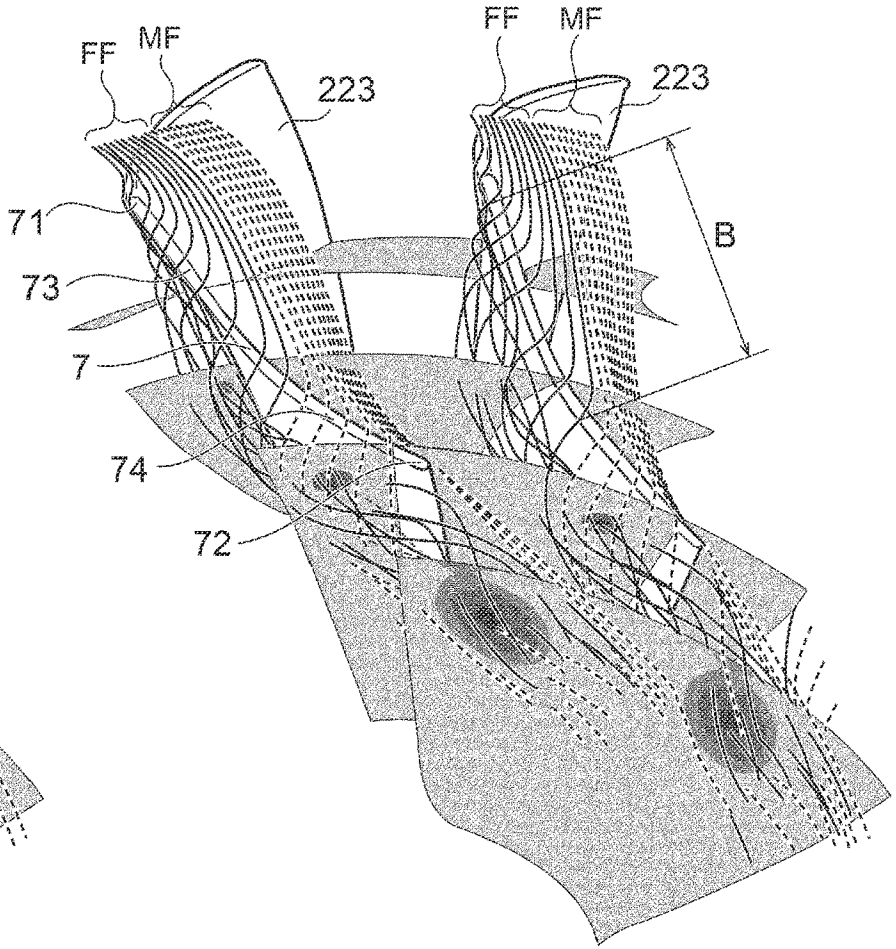
FIG. 4 is a schematic diagram of streamlines of a leakage flow that occurs in a shroud.
Figure 4A:
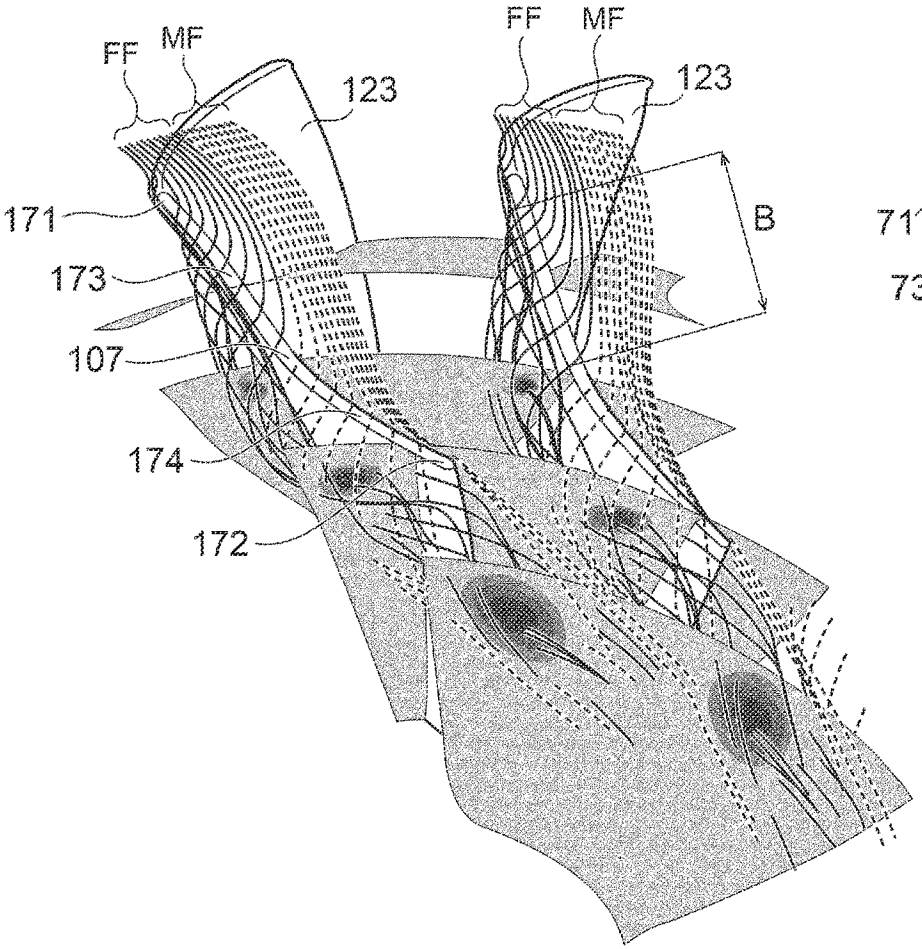

FIG. 3 is a meridional cross-sectional view schematically showing the shroud surface 6 and the side edge 7 of the blade 223 depicted in FIG. 2. FIGS. 4A and 4B are each a schematic diagram of streamlines of a leakage flow that occurs in the shroud surface 6.

As depicted in FIG. 3, the side edge 7 of the blade 223 has a side-edge upstream portion 73 disposed on the side of the inlet 61, and a side-edge downstream portion 74 disposed on the side of the outlet 62, while the shroud surface 6 has a shroud upstream portion 63 disposed on the side of the inlet 61 and extending along the side-edge upstream portion 73 and a shroud downstream portion 64 disposed on the side of the outlet 62 and extending along the side-edge downstream portion 74.

The shroud upstream portion 63 according to some embodiments has a meridional cross-sectional shape whose inclination angle with respect to the axis L of the hub 221 at the side of the inlet 61 is smaller ($\theta_0 > \theta_1$) as indicated by the solid line in FIG. 3, than in a case in which the shroud upstream portion 63 has a meridional cross-sectional shape of an arc shape and the shroud downstream portion 64 has a meridional cross-sectional shape of a linear shape along the direction of the axis L of the hub 221 as indicated by the two-dotted line in FIG. 3.

As depicted in FIG. 4A, if the shroud upstream portion 63 has a meridional cross-sectional shape of an arc shape and the shroud downstream portion 64 has a meridional cross-sectional shape of a linear shape along the direction of the axis L of the hub 221, a vicinity flow FF passes through the upstream region of the clearance, and an intermediate flow MF passes through the downstream region of the clearance.

On the other hand, as depicted in FIG. 4B, in a case where the shroud upstream portion 63 has a meridional cross-sectional shape whose inclination angle with respect to the axis of the hub at the inlet side is smaller ($\theta 0 > \theta 1a$) than in a case in which the shroud upstream portion 63 has a meridional cross-sectional shape of an arc shape and the shroud downstream portion 64 has a meridional cross-sectional shape of a linear shape along the direction of the axis of the hub, the region B in which the vicinity flow FF passes through the clearance can be expanded toward the downstream side, and thereby it is possible to suppress passage of the intermediate flow MM through the clearance. Accordingly, the clearance flow of a fluid flowing through the gap between the side edges 7 of the blades 223 and the shroud surface 6 is reduced.

In this embodiment, the side edge 7 of the blade 223 has a meridional cross-sectional shape whose inclination angle with respect to the axis L of the hub 221 at the side of a side-edge front end (leading edge end) 71 is smaller ($\theta 0a > \theta 1a$) as indicated by the solid line in FIG. 3, than in a case in which the side-edge upstream portion 73 has a meridional cross-sectional shape of an arc shape and the side-edge downstream portion 74 has a meridional cross-sectional shape of a linear shape along the direction of the axis L of the hub 221 as indicated by the two-dotted line in FIG. 3.

As depicted in FIG. 3, the shroud upstream portion 63 according to some embodiments has a meridional cross-sectional shape having a curvature radius R defined by the following expression 4, provided that R1 is the distance in the radial direction from the axis L of the hub 221 to the inlet 61, R2*t* is the distance in the radial direction from the axis L of the hub 221 to the outlet 62, and Ls is the length of the shroud surface 6 in the direction of the axis L of the hub 221.

$$R \geqq \frac{(R1 - R2t)^2 + Ls^2}{2(R1 - R2t)} \quad \text{(Expression 4)}$$

Accordingly, the meridional cross-sectional shape of the shroud upstream portion 63 has a curvature radius R defined by the expression 4, and thus it is possible to reduce the inclination angle with respect to the axis L of the hub 221 reliably.

In this embodiment, the side-edge upstream portion 73 of the blade 223 has a meridional cross-sectional shape having a curvature radius Ra defined by the following expression 5, provided that R1*a* is the distance in the radial direction from the axis L of the hub 221 to the side-edge front end (leading edge end) 71, R2*ta* is the distance in the radial direction from the axis L of the hub 221 to the side-edge rear end (trailing edge end) 72, and Lsa is the length of the side edge 7 of the blade 223 in the direction of the axis L of the hub 221.

$$Ra \geqq \frac{(R1a - R2ta)^2 + Lsa^2}{2(R1a - R2ta)} \quad \text{(Expression 5)}$$

Accordingly, the meridional cross-sectional shape of the side-edge upstream portion 73 of the blade 223 has a curvature radius Ra defined by the expression 5, and thus it is possible to reduce the inclination angle of the hub 221 with respect to the axis L reliably.

Furthermore, in this case, the difference (R-Ra) between the curvature radius R of the shroud surface 6 and the curvature radius of the side edge 7 of the blade 223 is the gap (clearance) between the shroud surface 6 and the side edge 7 of the blade 223.

FIGS. 5 to 12 are each a meridional cross-sectional view schematically showing the shroud surface 6 and the side edge 7 of the blade 223 according to some embodiments.

As depicted in FIGS. 5 and 6, and FIGS. 9 and 10, in some embodiments, the shroud downstream portion 64 is formed by an arc portion 65 having a meridional cross-sectional shape of an arc shape. Accordingly, since the shroud downstream portion 64 has the arc portion 65, it is possible to reduce the inclination angle of the shroud downstream portion 64 with respect to the axis L of the hub 221 gradually toward the outlet 62.

In this embodiment, the side-edge downstream portion 74 of the blade 223 is formed by an arc portion 75 having a meridional cross-sectional shape of an arc shape. Accordingly, since the side-edge downstream portion 74 has the arc portion 75, it is possible to reduce the inclination angle of the side-edge downstream portion 74 with respect to the axis L of the hub 221 gradually toward the side-edge rear end (trailing edge end) 26.

Figure 5:
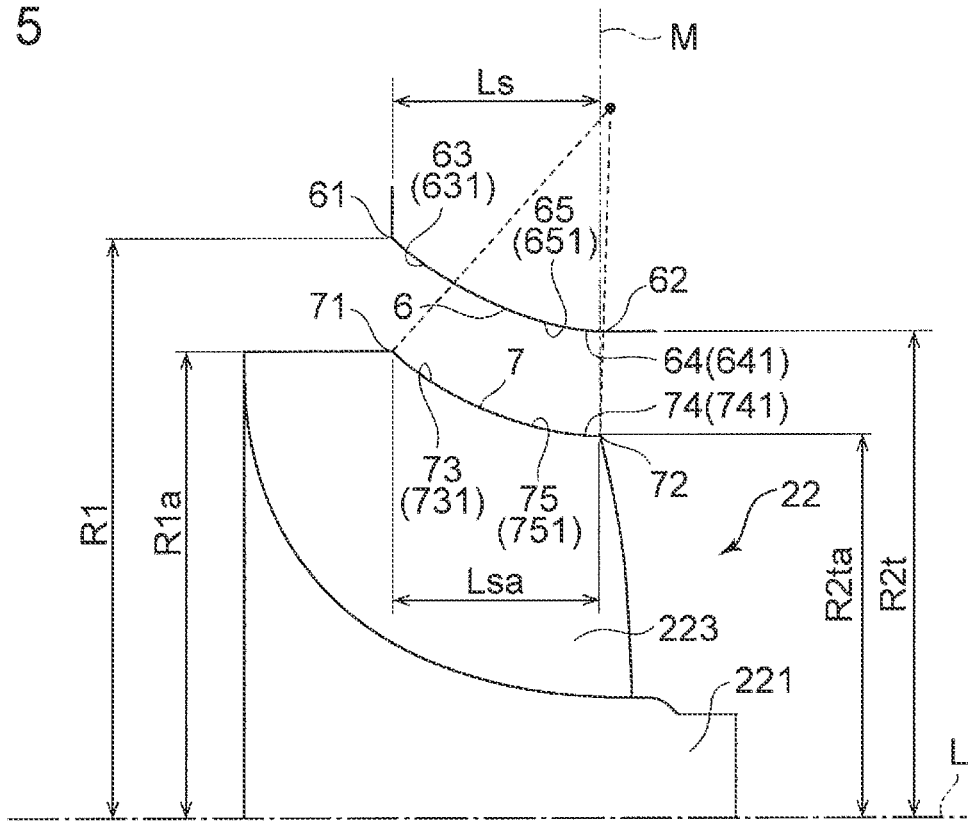
FIG. 5 is a meridional cross-sectional view schematically showing a shroud surface and a blade according to some embodiments.
Figure 6:
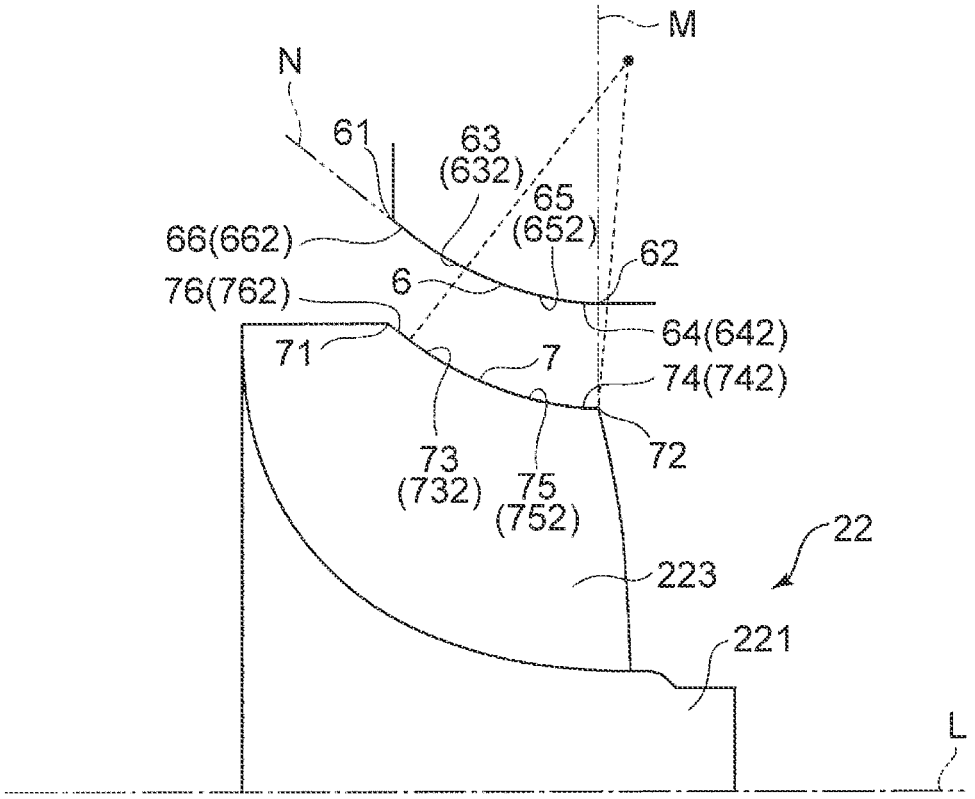
FIG. 6 is a meridional cross-sectional view schematically showing a shroud surface and a blade according to some embodiments.

As depicted in FIGS. 5 and 6, in some embodiments, the arc portion 65 has a meridional cross-sectional shape of a true arc shape (true circular arc shape). Accordingly, since the arc portion 65 has a meridional cross-sectional shape of a true arc shape, it is possible to reduce the inclination angle of the shroud downstream portion 64 with respect to the axis L of the hub 221 gradually toward the outlet 62.

In this embodiment, the arc portion 75 of the side-edge downstream portion 74 of the blade 223 has a meridional cross-sectional shape of a true arc shape. Accordingly, since the arc portion 75 has a meridional cross-sectional shape of a true arc shape, it is possible to reduce the inclination angle of the side-edge downstream portion 74 with respect to the axis L of the hub 221 gradually toward the side-edge rear end (trailing edge end) 72.

Figure 9:
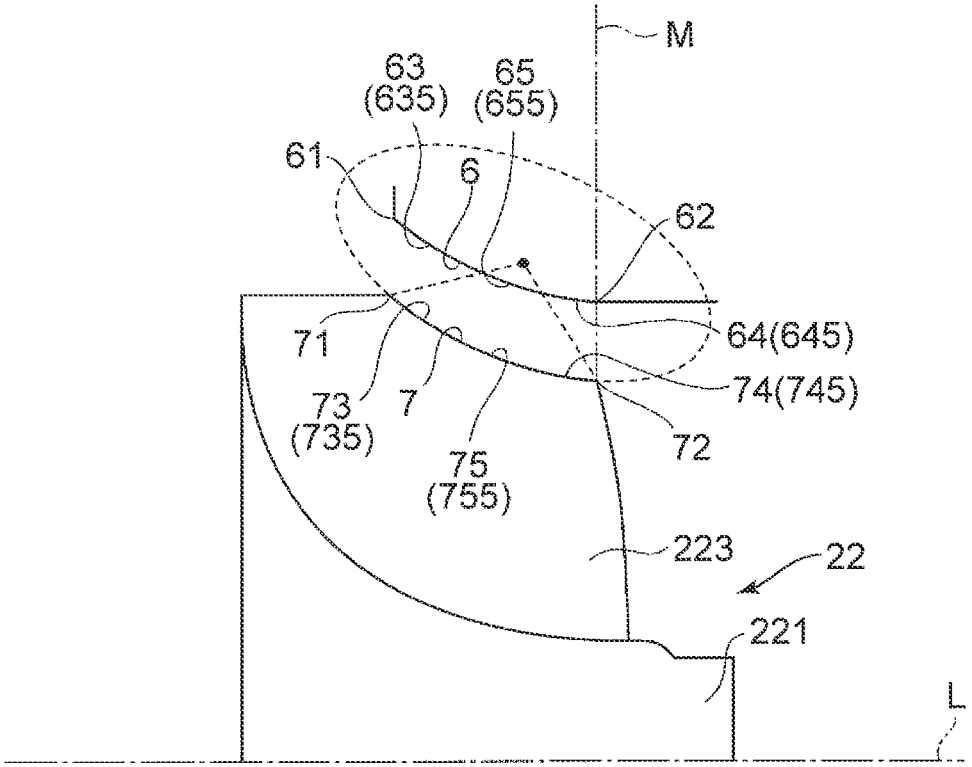
FIG. 9 is a meridional cross-sectional view schematically showing a shroud surface and a blade according to some embodiments.
Figure 10:
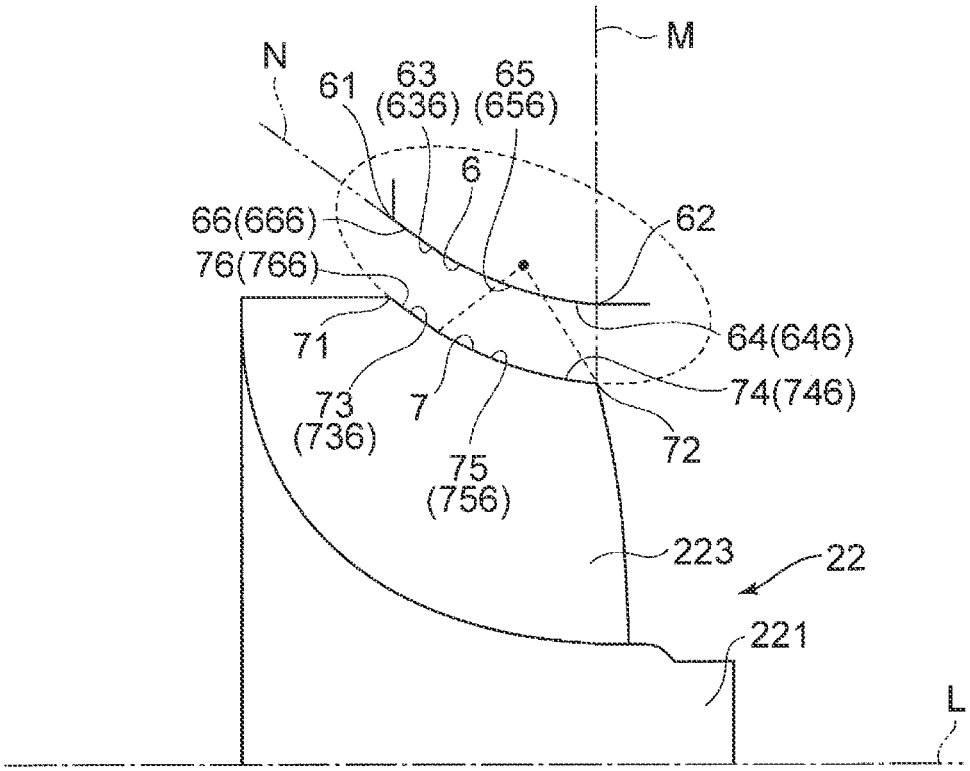
FIG. 10 is a meridional cross-sectional view schematically showing a shroud surface and a blade according to some embodiments.

As depicted in FIGS. 9 and 10, in some embodiments, the arc portion 65 has a meridional cross-sectional shape of an oval arc shape whose long axis is disposed inclined from the axis L of the hub 221. Accordingly, since the arc portion 65 has a meridional cross-sectional shape of an oval arc shape whose long axis is disposed inclined from the axis of the hub 221, it is possible to reduce the inclination angle of the shroud downstream portion 64 with respect to the axis L of the hub 221 gradually toward the outlet 62.

In this embodiment, the arc portion 75 of the side-edge downstream portion 74 of the blade 223 has a meridional cross-sectional shape of an oval arc shape whose long axis is disposed inclined from the axis L of the hub 221. Accordingly, since the arc portion 75 has a meridional cross-sectional shape of an oval arc shape whose long axis is disposed inclined from the axis L of the hub 221, it is possible to reduce the inclination angle of the side-edge downstream portion 74 with respect to the axis L of the hub 221 gradually toward the side-edge rear end (trailing edge end) 72.

As depicted in FIGS. 5 and 6, and FIGS. 9 and 10, in some embodiments, the center of curvature of the arc portion 65 of the shroud downstream portion 64 is disposed on a line M that passes through the outlet 62 and intersects with the direction of the axis L of the hub 221 at right angle, or downstream of the line M in the direction of the axis L of the hub 221. Accordingly, the inclination angle of the shroud surface 6 with respect to the axis L of the hub 221 is at least zero degree.

In this embodiment, the center of curvature of the arc portion 75 of the side-edge downstream portion 74 of the blade 223 is disposed on the line M that passes through the side-edge rear end (trailing edge end) 72 and intersects with the direction of the axis L of the hub 221 at right angle, or downstream of the line M in the direction of the axis L of the hub 221. Accordingly, the inclination angle of the side edge 7 of the blade 223 with respect to the axis L of the hub 221 is at least zero degree.

As depicted in FIGS. 6 and 7, and FIGS. 10 and 11, in some embodiments, the shroud upstream portion 63 is formed by a linear portion 66 having a meridional cross-sectional shape of a linear shape. Accordingly, since the shroud upstream portion 63 is formed by the linear portion 66, it is possible to make the inclination angle of the shroud upstream portion 63 with respect to the axis L of the hub 221 constant.

In this embodiment, the side-edge upstream portion 73 of the blade 223 is formed by a linear portion 76 having a meridional cross-sectional shape of a linear shape. Accordingly, since the side-edge upstream portion 73 has the linear portion 76, it is possible to make the inclination angle of the side-edge upstream portion 73 with respect to the axis L of the hub 221 constant.

As depicted in FIGS. 7 and 8, and FIGS. 11 and 12, in some embodiments, the shroud downstream portion 64 is formed by a linear portion 67 having a meridional cross-sectional shape of a linear shape inclined from the axis L of the hub 221. Accordingly, since the shroud downstream portion 64 has the linear portion 67, it is possible to make the inclination angle of the shroud downstream portion 64 with respect to the axis L of the hub 221 constant.

In this embodiment, the side-edge downstream portion 74 of the blade 223 is formed by a linear portion 77 having a meridional cross-sectional shape of a linear shape inclined from the axis L of the hub 221. Accordingly, since the side-edge downstream portion 74 has the linear portion 77, it is possible to make the inclination angle of the side-edge downstream portion 74 with respect to the axis L of the hub 221 constant.

As depicted in FIGS. 5 and 6, in some embodiments, the inclination angle of the shroud upstream portion 63 with respect to the axis L of the hub 221 in a meridional cross section is zero degree at the outlet. Accordingly, since the inclination angle of the shroud surface 6 is zero degree at the outlet 62, it is possible to discharge a fluid (exhaust gas) smoothly through the outlet 62.

In this embodiment, the inclination angle of the side-edge upstream portion 73 of the blade 223 with respect to the axis L of the hub 221 in a meridional cross section is zero degree at the side-edge rear end (trailing edge end) 72.

Furthermore, as depicted in FIG. 5, in some embodiments, the shroud surface 6 includes an arc portion 651 having a meridional cross-sectional shape of a true arc shape. The arc portion 651 is formed into an arc shape whose meridional cross-sectional shape passes through the inlet 61 and the outlet 62. With this configuration, the shroud upstream portion 631 and the shroud downstream portion 641 are formed by the single arc portion 651, and the shroud upstream portion 63 has a meridional cross-sectional shape whose inclination angle with respect to the axis L of the hub 221 at the side of the inlet 61 is smaller than in a case where the shroud upstream portion 631 has a meridional cross-sectional shape of an arc shape and the shroud downstream portion 641 has a meridional cross-sectional shape of a linear shape along the direction of the axis L of the hub 221.

Furthermore, with this configuration, the center of curvature of the arc portion 651 is disposed on the line M that passes through the outlet 62 and intersects with the direction of the axis L of the hub 221 at right angle, or downstream of the line M in the direction of the axis L of the hub 221. Accordingly, the inclination angle of the meridional cross section of the shroud surface 6 with respect to the axis L of the hub 221 is at least zero degree, and it is possible to reduce the inclination angle of the shroud downstream portion 641 gradually toward the outlet 62.

In this embodiment, the side edge 7 of the blade 223 includes an arc portion 751 having a meridional cross-sectional shape of a true arc shape. The arc portion 751 is formed into an arc shape whose meridional cross-sectional shape passes through the side-edge front end (leading edge end) 71 and the side-edge rear end (trailing edge end) 72. With this configuration, the side-edge upstream portion 731 and the side-edge downstream portion 741 are formed by the single arc portion 751, and the side-edge upstream portion 731 has a meridional cross-sectional shape whose inclination angle with respect to the axis L of the hub 221 at the side of the side-edge front end (leading edge end) 71 is smaller than in a case where the side-edge upstream portion 731 has a meridional cross-sectional shape of an arc shape and the side-edge downstream portion 741 has a meridional cross-sectional shape of a linear shape along the direction of the axis L of the hub 221.

Furthermore, with this configuration, the center of curvature of the arc portion 751 is disposed on the line M that passes through the side-edge rear end (trailing edge end) 72 and intersects with the direction of the axis L of the hub 221 at right angle, or downstream of the line M in the direction of the axis L of the hub 221. Accordingly, the inclination angle of the meridional cross section of the side edge 7 of the blade 223 with respect to the axis L of the hub 221 is at least zero degree, and the inclination angle of the side-edge downstream portion 741 can be reduced gradually toward the side-edge rear end (trailing edge end) 72.

Furthermore, in some embodiments, the center of curvature of the arc portion 651 is disposed on a line that passes through the outlet 62 and intersects with the direction of the axis of the hub 221 at right angle. With this configuration, the inclination angle of the meridional cross section of the shroud surface 6 with respect to the axis L of the hub 221 is at least zero degree, and reaches zero degree at the outlet 62. Accordingly, it is possible to discharge a fluid (exhaust gas) smoothly through the outlet 62.

In this embodiment, the center of curvature of the arc portion 751 of the side edge 7 of the blade 223 is disposed on the line M that passes through the side-edge rear end (trailing edge end) 72 and intersects with the direction of the axis L of the hub 221 at right angle. With this configuration, the inclination angle of the meridional cross section of the side edge 7 of the blade 223 with respect to the axis L of the hub 221 is at least zero degree, and reaches zero degree at the outlet.

Furthermore, as depicted in FIG. 5, the shroud surface 6 according to some embodiments has a meridional cross-sectional shape of a true arc shape having a curvature radius R defined by the following expression 6, provided that R1 is the distance in the radial direction from the axis L of the hub 221 to the inlet 61, R2*t* is the distance in the radial direction from the axis L of the hub 221 to the outlet 62, and Ls is the length of the shroud surface 6 in the direction of the axis L of the hub 221.

$$R = \frac{(R1 - R2t)^2 + Ls^2}{2(R1 - R2t)} \quad \text{(Expression 6)}$$

With this configuration, the inclination angle of the shroud surface 6 with respect to the axis L of the hub 221 decreases gradually toward the outlet 62 and reaches zero at the outlet 62. Accordingly, it is possible to rotate the turbine impeller 22 efficiently while reducing the clearance flow.

In this embodiment, the side edge 7 of the blade 774 has a meridional cross-sectional shape of a true arc shape having a curvature radius Ra defined by the following expression 7, provided that R1*a* is the distance in the radial direction from the axis L of the hub 221 to the inlet 71, R2*ta* is the distance in the radial direction from the axis L of the hub 221 to the side-edge rear end (trailing edge end) 72, and Lsa is the length of the side edge in the axial direction L of the hub 221.

$$Ra = \frac{(R1a - R2ta)^2 + Lsa^2}{2(R1a - R2ta)} \quad \text{(Expression 7)}$$

With this configuration, the inclination angle of the side edge 7 of the blade 223 with respect to the axis L of the hub 221 decreases gradually toward the side-edge rear end (trailing edge end) 72 and reaches zero at the side-edge rear end (trailing edge end) 72. Accordingly, it is possible to rotate the turbine impeller 22 efficiently while reducing the clearance flow.

Furthermore, in this case, the difference (R-Ra) between the curvature radius R of the shroud surface 6 and the curvature radius Ra of the side edge 7 of the blade 223 is the gap (clearance) between the shroud surface 6 and the side edge 7 of the blade 223.

Furthermore, as depicted in FIG. 6, in some embodiments, the shroud surface 6 includes an arc portion 652 having a meridional cross-sectional shape of a true arc shape and a linear portion 662 having a meridional cross-sectional shape of a linear shape. The arc portion 652 is formed into an arc shape whose meridional cross-sectional shape passes through the outlet 62, and the linear portion 662 is formed into a linear shape whose meridional cross-sectional shape passes through the inlet 61 and is a tangent N to the arc portion 652. With this configuration, the shroud upstream portion 632 is formed by the linear portion 662, and the shroud downstream portion 642 is formed by the arc portion 652. The shroud upstream portion 632 has a meridional cross-sectional shape whose inclination angle with respect to the axis L of the hub 221 at the side of the inlet 61 is smaller than in a case where the shroud upstream portion 632 has a meridional cross-sectional shape of an arc shape and the shroud downstream portion 642 has a meridional cross-sectional shape of a linear shape along the direction of the axis L of the hub 221.

Furthermore, with this configuration, the center of curvature of the arc portion 652 is disposed on the line M that passes through the outlet 62 and intersects with the direction of the axis L of the hub 221 at right angle, or downstream of the line M in the direction of the axis L of the hub 221. Accordingly, the inclination angle of the shroud surface 6 with respect to the axis L of the hub 221 is at least zero degree, and gradually decreases from the inlet 61 toward the outlet 62.

In this embodiment, the side edge 7 of the blade 223 includes an arc portion 752 having a meridional cross-sectional shape of a true arc shape and a linear portion 762 having a meridional cross-sectional shape of a linear shape. The arc portion 752 is formed into a true arc shape whose meridional cross-sectional shape passes through the side-edge rear end (trailing edge end) 72, and the linear portion 762 is formed into a linear shape whose meridional cross-sectional shape passes through the side-edge front end (leading edge end) 71 and is a tangent to the arc portion 752. With this configuration, the side-edge upstream portion 732 is formed by the linear portion 762, and the side-edge downstream portion 742 is formed by the arc portion 752. The side-edge upstream portion 732 has a meridional cross-sectional shape whose inclination angle with respect to the axis L of the hub 221 at the side of the side-edge front end (leading edge end) 71 is smaller than in a case where the side-edge upstream portion 732 has a meridional cross-sectional shape of an arc shape and the side-edge downstream portion 742 has a meridional cross-sectional shape of a linear shape along the direction of the axis L of the hub 221.

Furthermore, with this configuration, the center of curvature of the arc portion 752 is disposed on the line M that passes through the side-edge rear end (trailing edge end) 72 and intersects with the direction of the axis L of the hub 221 at right angle, or downstream of the line M in the direction of the axis L of the hub 221. Accordingly, the inclination angle of the side edge 7 of the blade 223 with respect to the axis L of the hub 221 is at least zero degree, and decreases gradually from the side-edge front end (leading edge end) 71 toward the side-edge rear end (trailing edge end) 72.

Figure 7:
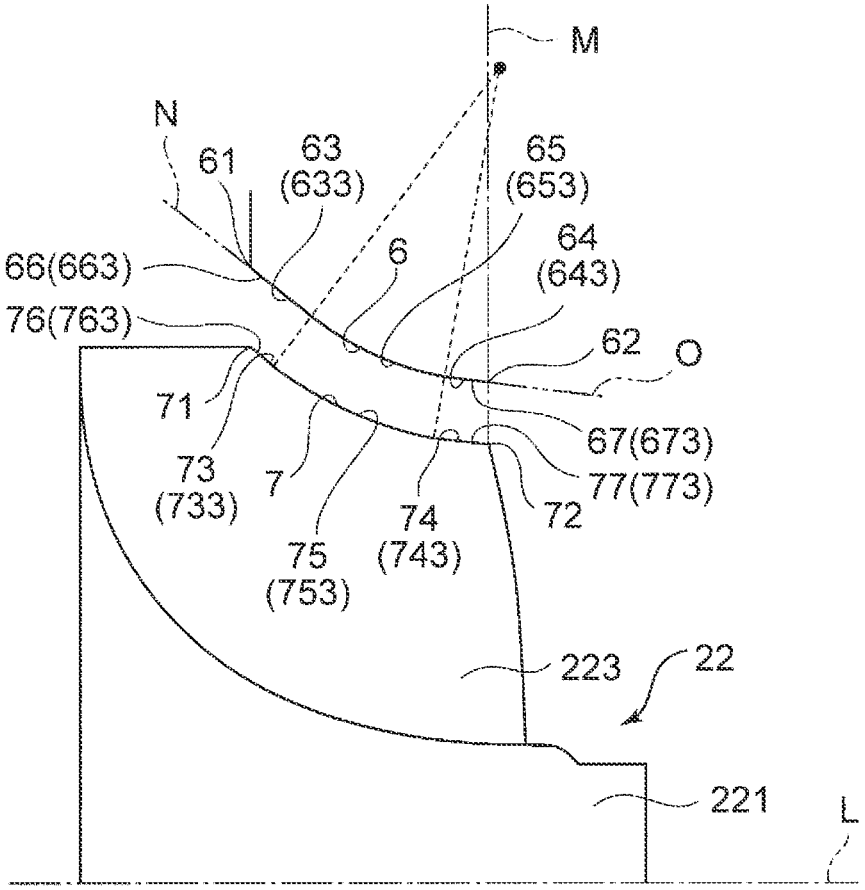
FIG. 7 is a meridional cross-sectional view schematically showing a shroud surface and a blade according to some embodiments.

Furthermore, as depicted in FIG. 7, in some embodiments, the shroud surface 6 includes an arc portion 653 having a meridional cross-sectional shape of a true arc shape, and a first linear portion 663 and a second linear portion 673 having a meridional cross-sectional shape of a linear shape. The center of curvature of the arc portion 653 is disposed on the line M that intersects with the direction of the axis L of the hub 221 at right angle, or downstream of the line M in the direction of the axis L of the hub 221. The first linear portion 663 is formed into a linear shape whose meridional cross-sectional shape passes through the inlet 61 and is a tangent N to the arc portion 653, and the second linear portion 673 is formed into a linear shape whose meridional cross-sectional shape passes through the outlet 62 and is a tangent O to the arc portion 653. With this configuration, the shroud upstream portion 633 is formed by the first linear portion 663, and the shroud downstream portion 643 is formed by the second linear portion 673. The shroud upstream portion 633 has a meridional cross-sectional shape whose inclination angle with respect to the axis L of the hub 221 at the side of the inlet 61 is smaller than in a case where the shroud upstream portion 633 has a meridional cross-sectional shape of an arc shape and the shroud downstream portion 643 has a meridional cross-sectional shape of a linear shape along the direction of the axis L of the hub 221.

With this configuration, the inclination angle of the shroud surface 6 with respect to the axis L of the hub 221 is larger than zero degree, and gradually decreases from the inlet 61 toward the outlet 62.

In this embodiment, the side edge 7 of the blade 223 includes an arc portion 753 having a meridional cross-sectional shape of a true arc shape, and a first linear portion 763 and a second linear portion 773 having a meridional cross-sectional shape of a linear shape. The center of curvature of the arc portion 753 is disposed on the line M that intersects with the direction of the axis L of the hub at right angle, or downstream of the line M in the direction of the axis L of the hub 221. The first linear portion 763 is formed into a linear shape whose meridional cross-sectional shape passes through the side-edge front end (leading edge end) 71 and is a tangent to the arc portion 753, and the second linear portion 773 is formed into a linear shape whose meridional cross-sectional shape passes through the side-edge rear end (trailing edge end) 72 and is a tangent to the arc portion 753. With this configuration, the side-edge upstream portion 733 is formed by the first linear portion 763, and the side-edge downstream portion 743 is formed by the second linear portion 773. The side-edge upstream portion 733 has a meridional cross-sectional shape whose inclination angle with respect to the axis L of the hub 221 at the side of the side-edge front end (leading edge end) 71 is smaller than in a case where the side-edge upstream portion 733 has a meridional cross-sectional shape of an arc shape and the side-edge downstream portion 743 has a meridional cross-sectional shape of a linear shape along the direction of the axis L of the hub 221.

With this configuration, the inclination angle of the side edge of the blade 223 with respect to the axis L of the hub 221 is greater than zero degree, and decreases gradually from the side-edge front end (leading edge end) 71 toward the side-edge rear end (trailing edge end) 72.

Figure 8:
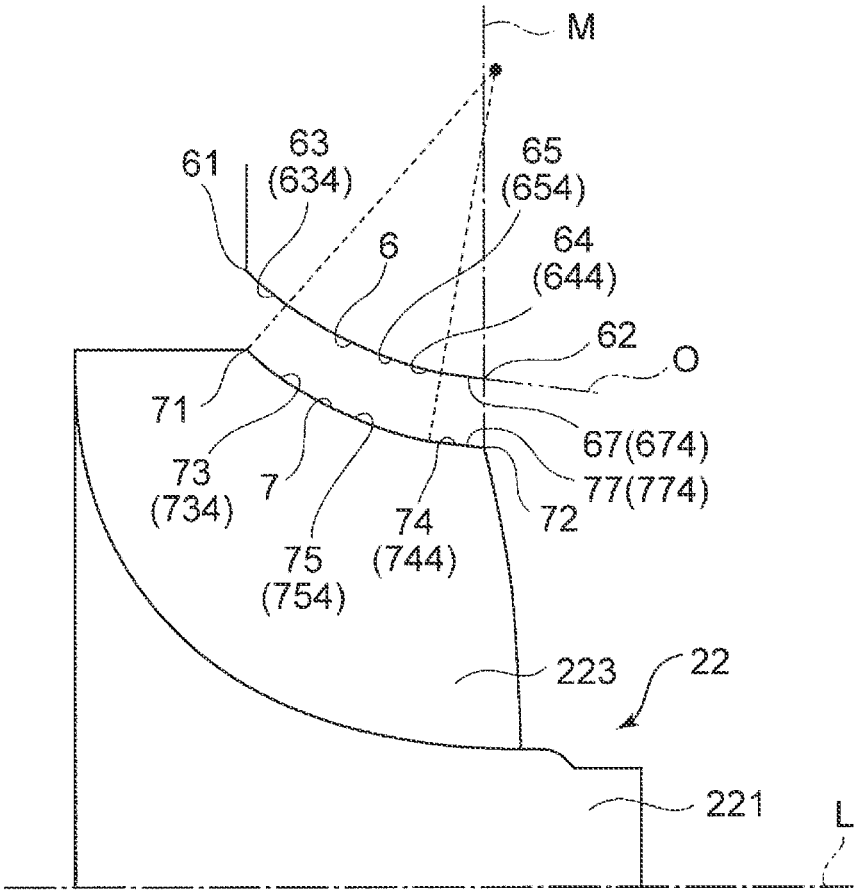
FIG. 8 is a meridional cross-sectional view schematically showing a shroud surface and a blade according to some embodiments.

Furthermore, as depicted in FIG. 8, in some embodiments, the shroud surface 6 includes an arc portion 654 having a meridional cross-sectional shape of a true arc shape and a linear portion 674 having a meridional cross-sectional shape of a linear shape. The arc portion 654 is formed into an arc shape whose meridional cross-sectional shape passes through the inlet 61, and the center of curvature of the arc portion 654 is disposed on the line M that intersects with the direction of the axis L of the hub 221 at right angle, or downstream of the line M in the direction of the axis L of the hub 221. The linear portion 674 is formed into a linear shape whose meridional cross-sectional shape passes through the outlet 62 and is a tangent O to the arc portion 654. With this configuration, the shroud upstream portion 634 is formed by the arc portion 654, and the shroud downstream portion 644 is formed by the linear portion 674. The shroud upstream portion 634 has a meridional cross-sectional shape whose inclination angle with respect to the axis L of the hub 221 at the side of the inlet 61 is smaller than in a case where the shroud upstream portion 634 has a meridional cross-sectional shape of an arc shape and the shroud downstream portion 644 has a meridional cross-sectional shape of a linear shape along the direction of the axis L of the hub 221.

With this configuration, the inclination angle of the shroud surface 6 with respect to the axis L of the hub 221 is larger than zero degree, and gradually decreases from the inlet 61 toward the outlet 62.

In this embodiment, the side edge 7 of the blade 223 includes an arc portion 754 having a meridional cross-sectional shape of a true arc shape and a linear portion 774 having a meridional cross-sectional shape of a linear shape. The arc portion 754 is formed into an arc shape whose meridional cross-sectional shape passes through the side-edge front end (leading edge end) 71, and the center of curvature of the arc portion 754 is disposed on the line M that intersects with the direction of the axis L of the hub 221 at right angle, or downstream of the line M in the direction of the axis L of the hub 221. The linear portion 774 is formed into a linear shape whose meridional cross-sectional shape passes through the side-edge rear end (trailing edge end) 72 and is a tangent to the arc portion 754. With this configuration, the side-edge upstream portion 734 is formed by the arc portion 754, and the side-edge downstream portion 744 is formed by the linear portion 774. The side-edge upstream portion 734 has a meridional cross-sectional shape whose inclination angle with respect to the axis L of the hub 221 at the side of the side-edge front end (leading edge end) 71 is smaller than in a case where the side-edge upstream portion 734 has a meridional cross-sectional shape of an arc shape and the side-edge downstream portion 744 has a meridional cross-sectional shape of a linear shape along the direction of the axis L of the hub 221.

With this configuration, the inclination angle of the side edge 7 of the blade 223 with respect to the axis L of the hub 221 is greater than zero degree, and decreases gradually from the side-edge front end (leading edge end) 71 toward the side-edge rear end (trailing edge end) 72.

As depicted in FIG. 9, in some embodiments, the arc portion 655 has a meridional cross-sectional shape of an oval arc shape whose long axis is disposed inclined from the axis L of the hub 221. With this configuration, the meridional cross-sectional shape is formed into a single oval arc shape whose meridional cross-sectional shape passes through the inlet 61 and the outlet 62. With this configuration, the shroud upstream portion 635 and the shroud downstream portion 645 are formed by the single arc portion 655, and the shroud upstream portion 635 has a meridional cross-sectional shape whose inclination angle with respect to the axis L of the hub 221 at the side of the inlet 61 is smaller than in a case where the shroud upstream portion 635 has a meridional cross-sectional shape of an arc shape and the shroud downstream portion 645 has a meridional cross-sectional shape of a linear shape along the direction of the axis L of the hub 221.

Furthermore, with this configuration, the center of curvature of the arc portion 655 is disposed on the line M that passes through the outlet 62 and intersects with the axial direction of the hub 221 at right angle, or downstream of the line M in the direction of the axis L of the hub 221. Accordingly, the inclination angle of the shroud surface 6 with respect to the axis L of the hub 221 in a meridional cross section is at least zero degree, and gradually decreases from the inlet 61 toward the outlet 62.

In this embodiment, the arc portion 755 of the side edge 7 of the blade 223 has a meridional cross-sectional shape of an oval arc shape whose long axis is disposed inclined from the axis of the hub 221. With this configuration, the arc portion 755 is formed into an oval arc shape whose meridional cross-sectional shape passes through the side-edge front end (leading edge end) 71 and the side-edge rear end (trailing edge end) 72 of the blade 223. With this configuration, the side-edge upstream portion 735 and the side-edge downstream portion 745 are formed by the single arc portion 755, and the side-edge upstream portion 735 has a meridional cross-sectional shape whose inclination angle with respect to the axis L of the hub 221 at the side of the side-edge front end (leading edge end) 71 is smaller than in a case where the side-edge upstream portion 735 has a meridional cross-sectional shape of an arc shape and the side-edge downstream portion 745 has a meridional cross-sectional shape of a linear shape along the direction of the axis L of the hub 221.

Furthermore, with this configuration, the center of curvature of the arc portion 755 is disposed on the line M that passes through the side-edge rear end (trailing edge end) 72 and intersects with the direction of the axis L of the hub 221 at right angle, or downstream of the line M in the direction of the axis L of the hub 221. Accordingly, the inclination angle of the side edge 7 of the blade 223 with respect to the axis L of the hub 221 in a meridional cross section is at least zero degree, and decreases gradually from the side-edge front end (leading edge end) 71 toward the side-edge rear end (trailing edge end) 72.

Furthermore, as depicted in FIG. 10, in some embodiments, the shroud surface 6 includes an arc portion 656 having a meridional cross-sectional shape of an oval arc shape and a linear portion 666 having a meridional cross-sectional shape of a linear shape. The arc portion 656 is formed into an oval arc shape whose meridional cross-sectional shape passes through the outlet 62, and is disposed so that the long axis of the oval is inclined from the axis L of the hub 221. The linear portion 666 is formed into a linear shape whose meridional cross-sectional shape passes through the inlet 61 and is a tangent N to the arc portion 656. With this configuration, the shroud upstream portion 636 is formed by the linear portion 666, and the shroud downstream portion 646 is formed by the arc portion 656. The shroud upstream portion 636 has a meridional cross-sectional shape whose inclination angle with respect to the axis L of the hub 221 at the side of the inlet 61 is smaller than in a case where the shroud upstream portion 636 has a meridional cross-sectional shape of an arc shape and the shroud downstream portion 646 has a meridional cross-sectional shape of a linear shape along the direction of the axis L of the hub 221.

Furthermore, with this configuration, the center of curvature of the arc portion 656 is disposed on the line M that passes through the outlet 62 and intersects with the direction of the axis L of the hub 221 at right angle, or downstream of the line M in the direction of the axis of the hub 221. Accordingly, the inclination angle of the shroud surface 6 with respect to the axis L of the hub 221 is at least zero degree, and gradually decreases from the inlet 61 toward the outlet 62.

In this embodiment, the side edge 7 of the blade 223 includes an arc portion 756 having a meridional cross-sectional shape of an oval arc shape and a linear portion 766 having a meridional cross-sectional shape of a linear shape. The arc portion 756 is formed into an oval arc shape whose meridional cross-sectional shape passes through the side-edge rear end (trailing edge end) 72 of the blade 223, and is disposed so that the long axis of the oval is inclined from the axis L of the hub 221. The linear portion 766 is formed into a linear shape whose meridional cross-sectional shape passes through the side-edge front end (leading edge end) 71 of the blade 223 and is a tangent to the arc portion 756. With this configuration, the side-edge upstream portion 736 is formed by the linear portion 766, and the side-edge downstream portion 746 is formed by the arc portion 756. The side-edge upstream portion 736 has a meridional cross-sectional shape whose inclination angle with respect to the axis L of the hub 221 at the side of the side-edge front end (leading edge end) 71 is smaller than in a case where the side-edge upstream portion 736 has a meridional cross-sectional shape of an arc shape and the side-edge downstream portion 744 has a meridional cross-sectional shape of a linear shape along the direction of the axis L of the hub 221.

Furthermore, with this configuration, the center of curvature of the arc portion 756 is disposed on the line M that passes through the side-edge rear end (trailing edge end) 72 and intersects with the direction of the axis L of the hub 221 at right angle, or downstream of the line M in the direction of the axis L of the hub 221. Accordingly, the inclination angle of the side edge 7 of the blade 223 with respect to the axis L of the hub 221 is at least zero degree, and decreases gradually from the side-edge front end (leading edge end) 71 toward the side-edge rear end (trailing edge end) 72.

Figure 11:
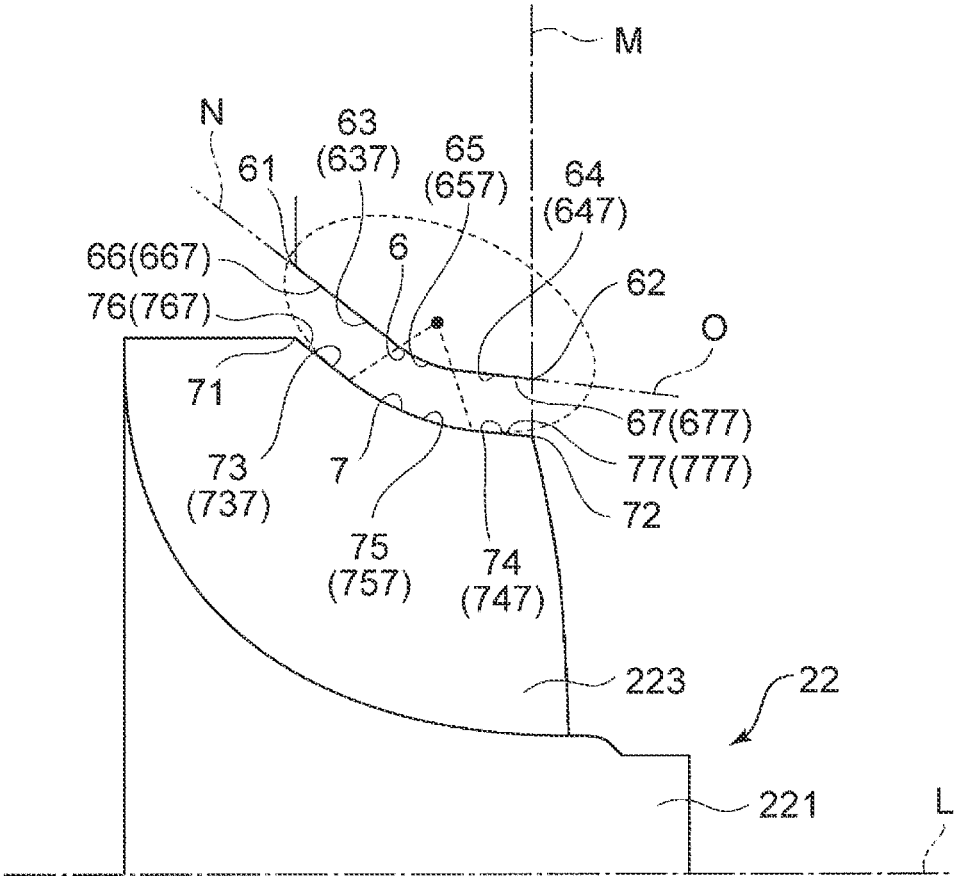
FIG. 11 is a meridional cross-sectional view schematically showing a shroud surface and a blade according to some embodiments.

Furthermore, as depicted in FIG. 11, in some embodiments, the shroud surface 6 includes an arc portion 657 having a meridional cross-sectional shape of an oval arc shape, and a first linear portion 667 and a second linear portion 677 having a meridional cross-sectional shape of a linear shape. The center of curvature of the arc portion 657 is disposed on the line M that intersects with the direction of the axis L of the hub at right angle, or downstream of the line M in the direction of the axis L of the hub 221, and the long axis of the oval is inclined from the axis L of the hub 221. The first linear portion 667 is formed into a linear shape whose meridional cross-sectional shape passes through the inlet 61 and is a tangent N to the arc portion 657, and the second linear portion 677 is formed into a linear shape whose meridional cross-sectional shape passes through the outlet 62 and is a tangent O to the arc portion 657. With this configuration, the shroud upstream portion 637 is formed by the first linear portion 667, and the shroud downstream portion 647 is formed by the second linear portion 677. The shroud upstream portion 637 has a meridional cross-sectional shape whose inclination angle with respect to the axis L of the hub 221 at the side of the inlet 61 is smaller than in a case where the shroud upstream portion 637 has a meridional cross-sectional shape of an arc shape and the shroud downstream portion 647 has a meridional cross-sectional shape of a linear shape along the direction of the axis L of the hub 221.

With this configuration, the inclination angle of the shroud surface 6 with respect to the axis L of the hub 221 is larger than zero degree, and gradually decreases from the inlet 61 toward the outlet 62.

In this embodiment, the side edge 7 of the blade 223 includes an arc portion 757 having a meridional cross-sectional shape of an oval arc shape, and a first linear portion 767 and a second linear portion 777 having a meridional cross-sectional shape of a linear shape. The center of curvature of the arc portion 757 is disposed on the line M that intersects with the direction of the axis L of the hub at right angle, or downstream of the line M in the direction of the axis L of the hub 221, and the long axis of the oval is inclined from the axis L of the hub 221. The first linear portion 767 is formed into a linear shape whose meridional cross-sectional shape passes through the side-edge front end (leading edge end) 71 and is a tangent to the arc portion 757, and the second linear portion 777 is formed into a linear shape whose meridional cross-sectional shape passes through the side-edge rear end (trailing edge end) 72 and is a tangent to the arc portion 757. With this configuration, the side-edge upstream portion 737 is formed by the first linear portion 767, and the side-edge downstream portion 747 is formed by the second linear portion 777. The side-edge upstream portion 737 has a meridional cross-sectional shape whose inclination angle with respect to the axis L of the hub 221 at the side of the side-edge front end (leading edge end) 71 is smaller than in a case where the side-edge upstream portion 737 has a meridional cross-sectional shape of an arc shape and the side-edge downstream portion 747 has a meridional cross-sectional shape of a linear shape along the direction of the axis L of the hub 221.

With this configuration, the inclination angle of the side edge of the blade 223 with respect to the axis L of the hub 221 is greater than zero degree, and decreases gradually from the side-edge front end (leading edge end) 71 toward the side-edge rear end (trailing edge end) 72.

Figure 12:
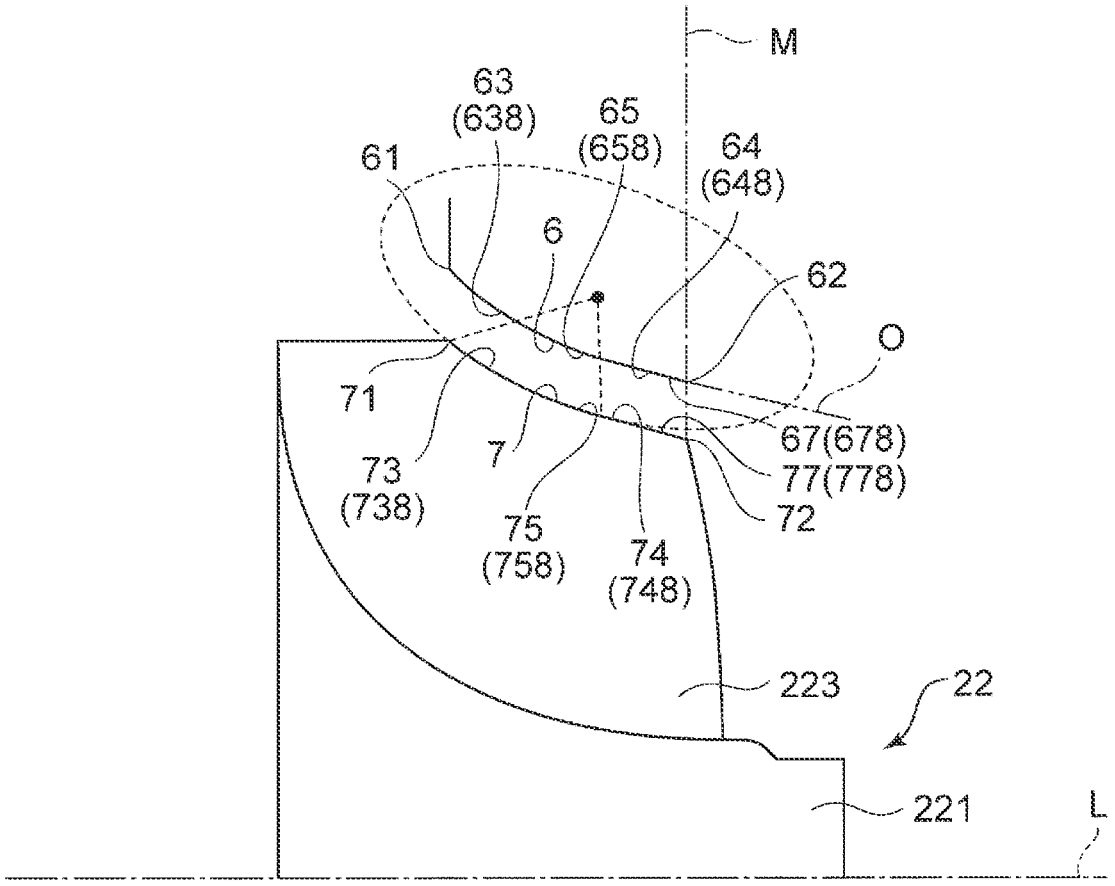
FIG. 12 is a meridional cross-sectional view schematically showing a shroud surface and a blade according to some embodiments.

Furthermore, as depicted in FIG. 12, in some embodiments, the shroud surface 6 includes an arc portion 658 having a meridional cross-sectional shape of an oval arc shape and a linear portion 678 having a meridional cross-sectional shape of a linear shape. The arc portion 658 is formed into an oval arc shape whose meridional cross-sectional shape passes through the inlet 61, and is disposed so that the long axis of the oval is inclined from the axis L of the hub 221. The linear portion 678 is formed into a linear shape whose meridional cross-sectional shape passes through the outlet 62 and is a tangent O to the arc portion 658. With this configuration, the shroud upstream portion 638 is formed by the arc portion 658, and the shroud downstream portion 648 is formed by the linear portion 678. The shroud upstream portion 638 has a meridional cross-sectional shape whose inclination angle with respect to the axis L of the hub 221 at the side of the inlet 61 is smaller than in a case where the shroud upstream portion 638 has a meridional cross-sectional shape of an arc shape and the shroud downstream portion 648 has a meridional cross-sectional shape of a linear shape along the direction of the axis L of the hub 221.

With this configuration, the inclination angle of the shroud surface 6 with respect to the axis L of the hub 221 is larger than zero degree, and gradually decreases from the inlet 61 toward the outlet 62.

In this embodiment, the side edge 7 of the blade 223 includes an arc portion 758 having a meridional cross-sectional shape of an oval arc shape and a linear portion 778 having a meridional cross-sectional shape of a linear shape. The arc portion 758 is formed into an oval arc shape whose meridional cross-sectional shape passes through the side-edge front end (leading edge end) 71, and is disposed so that the long axis of the oval is inclined from the axis L of the hub 221. The linear portion 778 is formed into a linear shape whose meridional cross-sectional shape passes through the side-edge rear end (trailing edge end) 72 and is a tangent to the arc portion 758. With this configuration, the side-edge upstream portion 738 is formed by the arc portion 758, and the side-edge downstream portion 748 is formed by the linear portion 778. The side-edge upstream portion 738 has a meridional cross-sectional shape whose inclination angle with respect to the axis L of the hub 221 at the side of the side-edge front end (leading edge end) 71 is smaller than in a case where the side-edge upstream portion 738 has a meridional cross-sectional shape of an arc shape and the side-edge downstream portion 748 has a meridional cross-sectional shape of a linear shape along the direction of the axis L of the hub 221.

With this configuration, the inclination angle of the side edge 7 of the blade 223 with respect to the axis L of the hub 221 is greater than zero degree, and decreases gradually from the side-edge front end (leading edge end) 71 toward the side-edge rear end (trailing edge end) 72.

Figure 13:
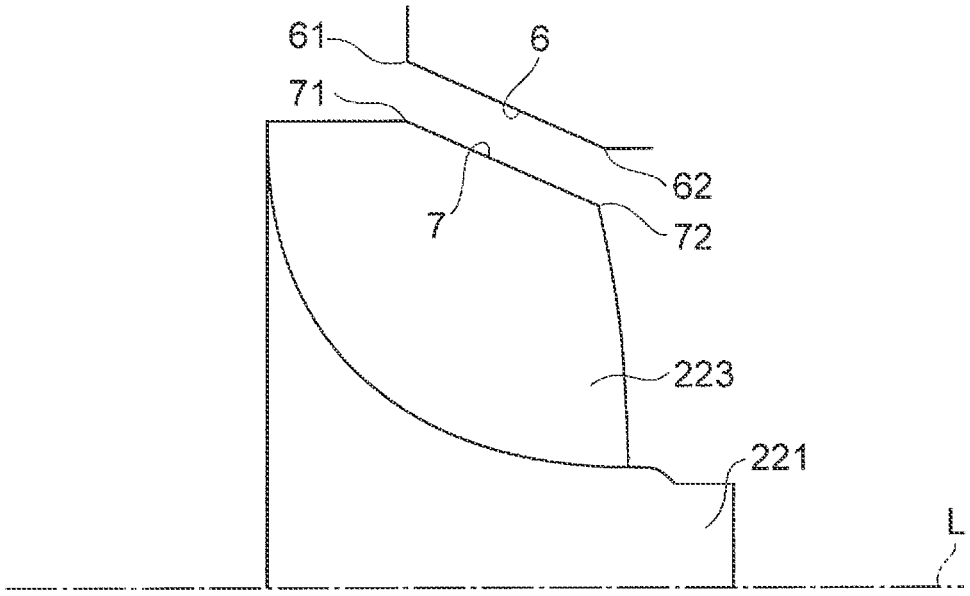
FIG. 13 is a meridional cross-sectional view schematically showing a shroud surface and a blade according to some embodiments.

FIG. 13 is a meridional cross-sectional view schematically showing the shroud surface according to some embodiments.

As depicted in FIG. 13, in some embodiments, the shroud surface 6 includes a meridional cross-sectional shape of a linear shape connecting the inlet 61 and the outlet 62.

With this configuration, it is possible to make the inclination angle of the shroud surface 6 with respect to the axis L of the hub 221 constant.

In this embodiment, the side edge 7 of the blade 223 has a meridional cross-sectional shape of a linear shape connecting the side-edge front end (leading edge end) 71 and the side-edge rear end (trailing edge end) 72.

With this configuration, it is possible to make the inclination angle of the side edge 7 of the blade 223 with respect to the axis L of the hub 221 constant.

It should be noted that the clearance between the side edge 7 and the shroud surface 6 is enlarged in FIGS. 3 to 13 just to help understanding, and the clearance is actually minute so that the side edge 7 and the shroud surface 6 are similar in the meridional cross-sectional shape.

Embodiments of the present invention were described in detail above, but the present invention is not limited thereto, and various amendments and modifications may be implemented.

DESCRIPTION OF REFERENCE NUMERALS

1 Turbocharger
2 Turbine
21 Turbine housing
211 Connection flange
212 Coupling
22 Turbine impeller
221 Hub

222 Back surface
223 Blade
23 Cylindrical section (shroud section)
231 Opening
24 Scroll section
25 Throat portion
26 Back plate
3 Compressor
31 Compressor housing
32 Impeller
321 Hub
322 Back surface
323 Blade
33 Lid member
331 Seal hole
34 Cylindrical section
35 Scroll section
36 Diffuser section
4 Bearing housing
41 Connection flange
42 End wall
421 Seal portion
422 Seal hole
43 Peripheral wall
431 Oil feed port
432 Oil drain port
44 Bearing section
441 Bearing hole
442 Floating bush
45 Thrust member
46 Thrust collar
47 Thrust sleeve
48 Oil deflector
5 Drive shaft
51 Male screw
52 Nut
6 Shroud surface
61 Inlet
62 Outlet
63, 631 to 638 Shroud upstream portion
64, 641 to 648 Shroud downstream portion
65, 651 to 658 Arc portion
66, 662, 666 Linear portion
663, 667 First linear portion
67, 674, 678 Linear portion
673, 677 Second linear portion
7 Side edge
71 Side-edge front end (leading edge end)
72 Side-edge rear end (trailing edge end)
73, 731 to 738 Side-edge upstream portion
74, 741 to 748 Side-edge downstream portion
75, 751 to 758 Arc portion
76, 762, 766 Linear portion
763, 767 First linear portion
77, 774, 778 Linear portion
773, 777 Second linear portion
L Axis of hub
FF Vicinity flow
MF Intermediate flow

The invention claimed is:

1. A turbine, comprising:

a housing including an inlet, an outlet, and a shroud section having a shroud surface extending between the inlet and the outlet; and a turbine impeller housed in the housing and including a hub and a plurality of blades disposed on an outer peripheral surface of the hub, each of the blades having a side edge extending along the shroud surface, wherein the side edge of each of the blades has a side-edge upstream portion disposed on a side of the inlet, and a side-edge downstream portion disposed on a side of the outlet, wherein the shroud surface has a shroud upstream portion disposed on the side of the inlet and extending along the side-edge upstream portions of the blades, and a shroud downstream portion disposed on the side of the outlet and extending along the side-edge downstream portion, and wherein the shroud upstream portion has a meridional cross-sectional shape having a curvature radius R defined by following expression 1:

$$R \geqq \frac{(R1 - R2t)^2 + Ls^2}{2(R1 - R2t)}$$

where R1 is a distance in a radial direction from an axis of the hub to the inlet, R2*t* is a distance in the radial direction from the axis of the hub to the outlet, and Ls is a length of the shroud surface in a direction of the axis of the hub, and wherein the shroud downstream portion has a meridional cross-sectional of an arc shape having a curvature radius R defined by following expression 2:

$$R = \frac{(R1 - R2t)^2 + Ls^2}{2(R1 - R2t)}.$$

2. The turbine according to claim 1, wherein a ratio Ls/D1 of the length Ls to an inner diameter D1 is greater than 0.16, provided that D1 is an inner diameter of the shroud at the inlet.

3. The turbine according to claim 1, wherein a ratio of a distance R2*t* to a distance R1 is not more than 0.95, provided that R1 is a distance in a radial direction from the axis of the hub to the inlet, and R2*t* is a distance in the radial direction from the axis of the hub to the outlet.

* * * * *